United States Patent [19]

Fukushima et al.

[11] 3,965,861

[45] June 29, 1976

[54] SEPARATED ROLLER LIQUID DEVELOPMENT

[75] Inventors: Osamu Fukushima; Seiji Matsumoto; Masamichi Sato, all of Asaka, Japan

[73] Assignee: Rank Xerox Ltd., London, England

[22] Filed: Sept. 4, 1974

[21] Appl. No.: 503,200

[52] U.S. Cl. ..... 118/637

[51] Int. Cl.[2] ..... G03G 13/10

[58] Field of Search ..... 118/DIG. 23, 637; 117/37 LE; 355/10; 427/15, 16, 17

[56] References Cited

UNITED STATES PATENTS

| | | | |
|---|---|---|---|
| 3,753,419 | 8/1973 | Fukushima et al. | 118/637 |
| 3,783,827 | 1/1974 | Fukushima et al. | 117/37 LE X |
| 3,808,025 | 4/1974 | Fukushima et al. | 117/37 LE |
| 3,822,670 | 7/1974 | Sato et al. | 118/637 |

*Primary Examiner*—Morris Kaplan

[57] ABSTRACT

An apparatus for development of electrostatic latent images using liquid developers whereby development rollers positioned in development configuration are separated by a conductive fixed member having one surface thereof closely spaced from the latent image bearing member and having at least one surface closely spaced from the development roller.

4 Claims, 8 Drawing Figures

SEPARATED ROLLER LIQUID DEVELOPMENT

Figure 1:
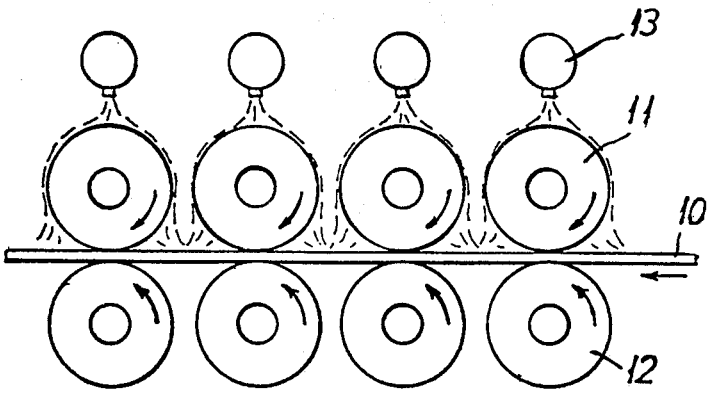

This invention relates to development of electrostatic latent images. More particularly this invention relates to a unique apparatus for accomplishing liquid development of electrostatic latent images.

Many development systems and apparatus configurations are known for making visible images formed by electrostatic means. The formation of such images on insulation surfaces or photoconductive surfaces is well known. The basic electrostatographic process, as taught by Carlson in U.S. Pat. No. 2,297,691, involves placing a uniform electrostatic charge on a photoconductive insulating layer, exposing the layer to a light and shadow image to dissipate the charge on the areas of the layer exposed to the light, and developing the remaining electrostatic latent image by depositing on the image a finely divided electroscopic marking material sometimes called "toner". Toner will normally be attracted to those areas of the layer which retain a charge, thereby forming a toner image corresponding to the electrostatic latent image. This powder image may then be transferred to a support surface such as paper. Such a transferred image may subsequently be permanently affixed. It is well known that a latent image may be formed on an appropriate surface by direct charging in image configuration. Likewise, one may develop and fix an image to a latent image holding substrate.

Development of an electrostatic latent image may also be achieved with liquid rather than dry developer materials. In liquid development, commonly referred to as electrophoretic development, an insulating liquid vehicle having finely divided solid marking material dispersed therein contacts the latent image bearing surface in both charged and uncharged areas. Under the influence of the electric field associated with the charged image pattern, these suspended particles migrate toward the charged portions of the imaging surface thus separating out of the insulation liquid. The deposition of these particles develops the electrostatic image.

This invention relates to an improvement in liquid developing apparatus.

Apparatus for developing electrostatographic images present on a dielectric, photoconductive, insulation, or other appropriate surfaces are well known. In one, an electrostatic latent image bearing substrate is conveyed between two rollers or a plurality of two roller surfaces. Liquid developer comprising pigment, resin, graft pigment or other marking particles or materials suspended in an insulating carrier liquid is permitted to flow over and round the roller which faces the electrostatic latent image to contact and develop the same. Such techniques are taught in U.S. Pat. Nos. 2,913,353; 3,299,787; and British Pat. No. 1,011,212 which teachings and techniques are herein incorporated by reference.

In U.S. Pat. No. 2,913,353, the rollers are brought into contact with the surface of the imaging material by pinching. This action develops and conveys the image bearing substrate through the developing zone. While this technique works well, it has been recognized that several improvements would be desirable.

Firstly, there is an edge effect which is often present which occurs between rollers adjacent to each other due to the absence of the developing electrode near the latent image. What is meant by the edge effect is a phenomenon where a wide region having uniform density is not developed having uniform density, but is developed with more density in the surroundings or fringe than in the middle. This phenomenon may be expressed as "solid black" not being developed. In the apparatus of the prior art illustrated in FIG. 1, the "solid black" problem sometimes occurs, but more importantly, a fine image, such as that of a man's face for example, is developed not with the fine and smooth texture desired, but with a rough, uneven texture. Often the phenomenon occurs resulting in small concavities and conveities which are so accentuated that an odd look is given to the image, and this is called "microscopic edge effect."

Secondly, is the effect of irregular line density development. This is believed to be caused by undulation in the adjacent rollers which cause irregularity in development density as a function of the undulation of the developed surface. The irregularity in density is noticeable particularly in highlighted regions or regions lower in density, degrading the quality of the image to a considerable extent.

It is an object of the present invention to provide for a unique liquid developing system. It is a further object to provide for solutions to the above-mentioned needs and problems. It is yet a further object to provide for apparatus which can easily and simply develop clean, high resolution electrostatic latent images. Another object of this invention is to provide apparatus which eliminates the phenomenon of microscopic edge effect and image degradation due to undulation and/or other causes. Other objects and advantages will become apparent from a full reading of the specification.

The present invention accomplishes these objects and others by providing a unique structure and a unique apparatus for developing electrostatic latent images employing liquid developer. The present invention is useful in any mode of liquid development of images, either direct or reversal.

Surprisingly, it has been found that a conductive, fixed member positioned between adjacent rollers on the latent image bearing surface side accomplishes the objects of this invention and provides for unique and excellent development of images using roller liquid development.

The invention will be further described with respect to the drawings which represent a few of the many embodiments of this invention. FIG. 1 is a schematic sectional view of the general development apparatus used in this invention, but without the unique fixed member mentioned above. While it is not always required, usually a plurality of pairs of rollers is employed to develop an image. FIGS. 2 through 8 illustrate various embodiments of the present invention showing the important parts thereof, in which only two pairs of rollers are depicted, but it is to be understood that any number of rollers may be employed.

It will be apparent to one skilled in this art that many modifications can be made to the structures given herein without material change to the invention. Such changes are herein contemplated.

FIG. 1 is a sectional or side view of a conventional development apparatus which is known in the prior art. Designated by 10 is an electrophotographic material bearing an electrostatic latent image. Two rollers, 11 and 12, are used to feed the latent image bearing material 10 and to hold or support the same for or during development. The side of material 10 bearing the latent image to be developed is facing roller 11 while the obverse side is supported or contacted by roller 12. Roller 11 is conductive, being made of metal or other appropriate material, and serves as a developing electrode. Roller 12 may be made of metal or any other suitable material.

The roller 11 may either contact or be slightly apart from the surface bearing the latent image. Nozzle 13 is intended for use to supply the liquid developer to the surface bearing the latent image surface for development by spraying the liquid developer toward roller 11. These rollers are driven in the arrow directions by means of a suited driving device which is not illustrated.

As the latent image bearing material is passed between the developing rollers in the direction indicated, the liquid developer makes the image visible.

Figure 2:
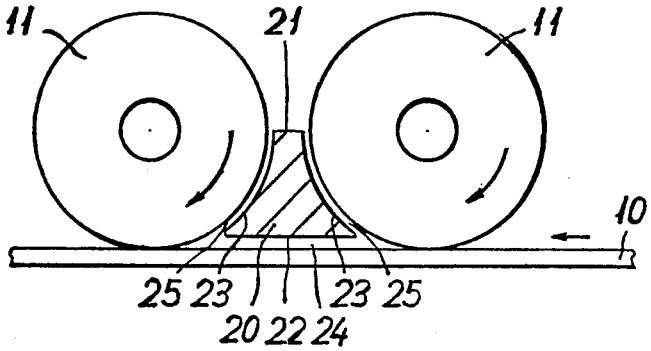

FIG. 2 illustrates one embodiment of the invention. Only two upper adjacent rollers are depicted in FIG. 2, but any number may be used in the fashion shown in FIG. 1; this applies as well to the embodiments shown in FIGS. 3 through 8.

One important embodiment of the invention as shown in FIG. 2 is member 20 which makes uniform the flow of developer and helps to eliminate microscopic edge effect.

The member 20 has a length (vertical to the sheet surface) almost equal to that of the roller 11. The sectional form of 20 is so determined that it will fill up the space between the rollers 11 adjacent to each other and leave only a very small space between each of the rollers 11 and between it and the surface bearing the latent image. The top surface 21 of the member 20 is roughly within the plane involving the center axes of the rollers 11 adjacent to each other. The bottom surface 22 is so located as to leave a small space between it and the surface bearing the latent image.

The surfaces 23 of the member 20 facing the rollers 11 are on the cylindrical surface roughly concentric with the rollers 11 and form small clearances 25 with the rollers 11.

Clearance 24 may be of any spacing as long as there is no contact between the fixed member and the latent image bearing surface. Spaces larger than about 1mm should generally be avoided since larger spaces lessens the effect of the development electrode. We have found that good results are obtained when the clearance is from about 0.1 to about 0.5 mm.

The clearance 25 is not particularly critical and may be of any reasonable spacing. Very small spacings should be avoided if they make it difficult for the developer to pass between the member and the roller electrode. This results in insufficient availability of developer. Very large spaces should be avoided if the uniform flow of developer is disturbed. Generally, a clearance of from about 0.2 to about 2 mm is satisfactory.

While the member or face 22 is preferably metal, it may be of any electrically conductive material. The rollers and the member 20 are supported by side plates which are not shown. Rollers 11 are easily removable by lifting upward for replacement or cleaning.

Figure 3:
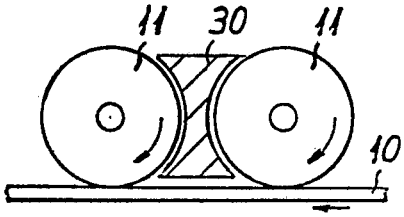

FIG. 3 illustrates a side view of another embodiment of the present invention, wherein the member 30 is used in place of the member 20 shown in FIG. 2. The member 30 has a section approximately symmetrical vertically. The position of the member 30 is the same or similar to the member 20 of the apparatus illustrated in FIG. 2. Compared with FIG. 2, the flow of the liquid developer can be made more uniform in this embodiment. Of course, removal of the rollers for replacement or cleaning must be accomplished through the side plate (not shown) or the entire copper development structure must be removed.

Figure 4:
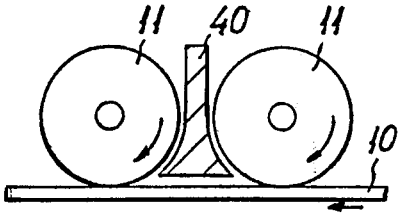

FIG. 4 is a side view of still another and more advantageous embodiment of the present invention. The member 40 is similar to the members 20 and 30 described hereinbefore in terms of shape and performance. In this embodiment, the member 40 is not in the way when the roller 11 is lifted upward. The flow of the developer can be more uniform than in the embodiment shown in FIG. 2.

Figure 5:
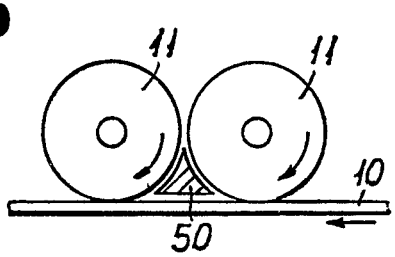

FIG. 5 is a side view of still another embodiment of the present invention. The member 50 may be considered similar to member 20 in FIG. 2, but without the area of the top 21. When the clearance between the rollers 11 adjacent to each other is very small, the use of such a member is more effective. In the above-mentioned embodiments of the invention, the top of each of the members 20, 30 and 40 may have a through opening with a hollow inside.

Figure 6:
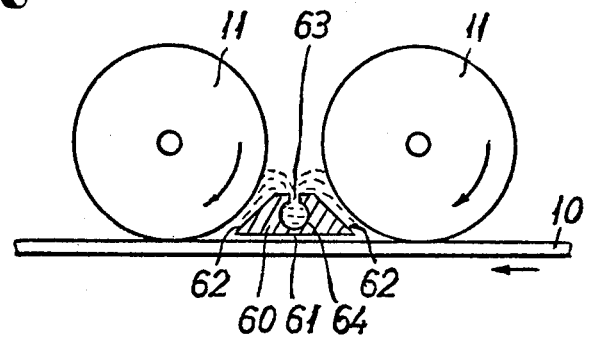

FIG. 6 is a side view of a further devised apparatus of the present invention, in which the member 60 is a developer feed port-added version of the member 20 that generally characterizes the present invention. In this mode, it can be seen that Nozzels 13 of FIG. 1 can be omitted. The bottom 61 or the whole of the member 60 must be made of a conductive material, such as metal, as in the case of other embodiments of the present invention as shown in FIG. 2 through 5. Thus, either 60 or the bottom 61 can serve as a developing electrode.

The member 60 serves as the member 20 of the apparatus illustrated in FIG. 2 does in that it eliminates the edge effect and prevents irregularity in density otherwise caused by the disturbed flow of the developer. The surface of the member 60 facing the roller forms a small space with the roller 11. The space may range from 0.2 to 2 mm as hereinbefore mentioned. A smaller clearance may cause a reduced flow of the developer resulting in a shortage of the developer supplied. A larger space may permit the developer to be supplied to the surface bearing the latent image in a disturbed flow, causing an irregularity in density. In the top of the member 60 is provided a slit 63, with a tubular hollow reservoir 64 therein.

The developer is furnished to this hollow reservoir 64 by means of a pump which is not shown, wherein it is permitted to overflow through slit 63 into the space between the rollers 11 and the side surfaces of the member 60 and thereby supplied to the surface bearing the latent image for development. This way of supplying the developer has an advantage over such a method as is employed in the apparatus shown in FIG. 1 where the developer is made to run down from above in that the developer is allowed to run in a laminar flow without being disturbed.

Figure 7:
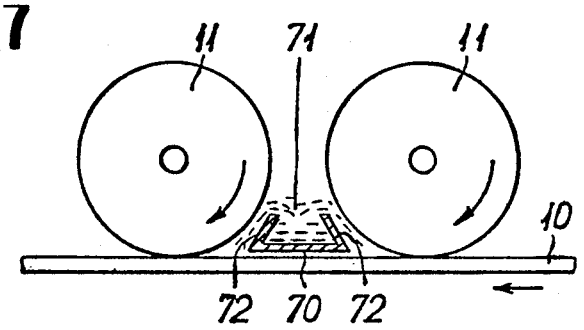

FIG. 7 illustrates a variation in the embodiment of the invention shown in FIG. 6. The member 70 serves in a similar fashion to member 60 in the apparatus illustrated in FIG. 6. The member 70 is shaped like a slender box with an opening 71 on top. When the developer is supplied into the member 70 as in the case of FIG. 6, it overflows the side walls 72 and is supplied onto the surface bearing the latent image in a laminar flow pattern. The member 70 is easier to manufacture than the member 60. The clearances between the member 70 and the rollers 11 and the surface bearing the latent image are the same as heretofor mentioned.

Figure 8:
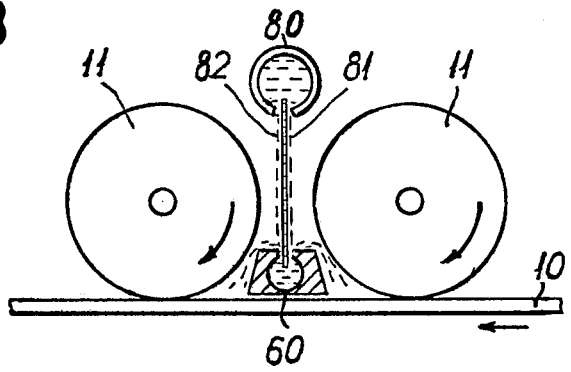

FIG. 8 illustrates another variation of the apparatus of the present invention as illustrated in FIG. 6. Designated by 80 is a developer feed pipe, whereunder a slit 81 is provided. Plate 82 vertically extends from the slit 81 into the slit of the member 60. The developer runs out of the slit 81, runs down the surface of the plate 82, is collected in the hollow of the member 60 and is permitted to overflow to the surface bearing the latent image.

The unique member which is present between the developing rollers in this invention may be of virtually any shape as can be seen by the above description. That portion of the member which is in close proximity with the latent image bearing member acts as a development electrode. But additionally this member forms a closely spaced conduit with the developing rollers to provide for controlled developer application. It is important that the developer flow be laminar, and turbulent flow avoided if possible as this gives the more beneficial result.

The laminar flow is a function of the developer itself as well as the apparatus. At low rates of flow, the velocity profile is established by friction between adjacent layers of fluid, and the individual particles of developer follow the flow lines in what is termed laminar or stream-line flow. What should be avoided in order to achieve some of the benefits of this invention is where a critical velocity is reached at which flow becomes turbulent as the individual fluid particles pursue erratic transverse paths. These terms are related to the Friction Factor which is often described as the Reynolds number. If the Reynolds number is kept to a value below about 2,000, laminar flow is usually accomplished. The Reynolds number may be calculated by multiplying the cross section of the spacing between the conductive fixed member and the roller 11 by the mass velocity of developer flow and dividing the resultant product by the viscosity of the developer. From this is can be seen that the spacing is to be determined by the artisan in order to achieve laminar flow and the spacings given here are merely representative of generally satisfactory values.

The development liquid used in the present invention may be one in which colored fine charged particles are suspended in an electric insulating liquid. Carbon black and other organic and inorganic pigments may be employed. The carrier liquid may be cyclohexane, kerosene, decalin, heptane, and other like liquids. It is generally preferred that the liquid have a resistance greater than about $10^7$ ohm-cm, and preferably between $10^{10}$ and $10^{14}$ ohm-cm.

The development electrode rollers are preferably made of metal including stainless steel, steel, brass, duralmine, etc. A very thin film of insulating or semiconductive oxide formed by anodizing or acid treatment may be provided on them. Rollers of a wide range of diameter are available, which may be 1 mm to 10 cm or more, in general, but more preferably may be from several mm to several cm. The number of the development electrode rollers used may be determined by taking the development velocity into account; for a lower velocity, i.e., circular velocity of the roller, a small number of rollers are needed, and for a higher velocity the number must be increased. Practically, ten rolls are used. Carrier rollers may also be metallic, but more preferably such as those covered with rubber or sponge.

The development electrode rollers may be driven by a motor through gear, chain, belt or friction roller, the carrier rollers may be driven frictionally by the development rollers, or by gear, chain, belt, etc. Alternatively, the carrier rollers may be driven by a motor, and the development electrode rollers may be driven by the carrier rollers. The development electrode rollers and the carrier rollers may be pressed mutually, or the former may be placed on the latter by its own weight and rotated frictionally.

The background which is sometimes associated with electrophoretic development can be noticeably decreased by wetting the surface to be developed with a toner-free insulating liquid prior to development on account of decrease of toner deposition onto the surface by the forces other than electrostatic. Such pretreatment or pre-bathing can, of course, be utilized with the present apparatus and be quite effective especially when an electrophotographic sheet with a rough surface which is ready to attract and entrap toner particles. Further rinse operation of the sheet after development to remove the excessive developer liquid adhering on the surface is also effective to decrease background.

There may also be used a technique for improving the mechanical durability of the developed image by a stand squeezing operation, comprising utilizing a liquid developer in which a resinous material is dissolved in the carrier liquid and rinsing the developed sheet with a rinse liquid in which the resinous material is insoluble.

In the present invention, the interval between pairs of rollers may be widened by the thickness of the electrophotographic material. This is easily accomplished. For example, the rollers 11 may be disposed in a manner that the rollers 11 ride on the rollers 13 by dead load.

From the above description and discussion, it should be apparent that the apparatus and structure of this invention accomplish the objects of this invention and provide unique improvements over the structures of the prior art. The invention should not be limited to the embodiments as many variations are possible without deviating from the scope of the invention.

What is claimed is:

1. An apparatus for the development of electrostatographic latent images comprising at least one pair of rollers spaced in close proximity to one another capable of having a latent image bearing substrate interposed therebetween, means for furnishing liquid developer to the surface of one roller which functions as the developing roller and is adjacent the latent image when said substrate is present, a development electrode means having one surface concentric with and spaced in close proximity to the developing roller which, in cooperation with the developing roller within the range of about 0.2 to about 2 mm apart, forms a conduit for transporting the liquid developer in laminar flow having a Reynolds number below about 2000 to a latent image bearing substrate when interposed between said rollers.

2. The apparatus of claim 1 wherein said development electrode means comprises a conductive surface spaced in close proximity and in parallel plane to the path of the latent image bearing substrate.

3. The apparatus of claim 1 wherein said development electrode means is from about 0.1 to about 0.5 mm from the path of the latent image bearing substrate.

4. The apparatus of claim 1 wherein said development electrode means and means to furnish liquid developer to the developing roller are the same.

* * * * *